US008568176B2

(12) United States Patent
Huang et al.

(10) Patent No.: US 8,568,176 B2
(45) Date of Patent: Oct. 29, 2013

(54) TERMINAL MODULE FOR ELECTRIC CONNECTOR

(75) Inventors: Su-Hui Huang, Keelung (TW); Fu-Wen Wu, Keelung (TW); Chien-Ming Tu, Keelung (TW)

(73) Assignee: Telebox Industries Corp., New Taipei (TW)

( * ) Notice: Subject to any disclaimer, the term of this patent is extended or adjusted under 35 U.S.C. 154(b) by 403 days.

(21) Appl. No.: 13/152,332

(22) Filed: Jun. 3, 2011

(65) Prior Publication Data

US 2012/0309238 A1 Dec. 6, 2012

(51) Int. Cl.
*H01R 24/00* (2011.01)

(52) U.S. Cl.
USPC ..... 439/676

(58) Field of Classification Search
USPC ..... 439/676
See application file for complete search history.

(56) References Cited

U.S. PATENT DOCUMENTS

| | | | | |
|---|---|---|---|---|
| 6,350,156 | B1 * | 2/2002 | Hasircoglu et al. | 439/676 |
| 6,464,541 | B1 * | 10/2002 | Hashim et al. | 439/676 |
| 6,786,775 | B1 * | 9/2004 | Hanrahan et al. | 439/676 |
| 7,985,101 | B2 * | 7/2011 | Fitzpatrick | 439/676 |
| 7,985,102 | B2 * | 7/2011 | Bergner et al. | 439/676 |
| 8,435,084 | B2 * | 5/2013 | Caveney et al. | 439/676 |
| 8,485,850 | B2 * | 7/2013 | Nesme et al. | 439/620.11 |
| 2010/0144209 | A1 * | 6/2010 | Hetzer et al. | 439/676 |

* cited by examiner

*Primary Examiner* — Neil Abrams
(74) *Attorney, Agent, or Firm* — Jackson IPG PLLC

(57) ABSTRACT

A terminal module used in an RJ45 female connector in which the first transmission terminal includes a triangle support portion having a downward bent downwardly extended from the bonding portion and an upward bent connected with the lower end thereof to the downward bent and the upper end thereof to the contact portion. The eighth transmission terminal includes a support portion obliquely upwardly from the bonding portion and terminating in the contact portion. Further, the contained angle defined between the inner end of the bonding portion of the eighth transmission terminal and the support portion and the contained angle defined between the contact portion of the eighth transmission terminal and the support portion are arc guide angles. These terminal shapes are used to prevent terminal deformation upon insertion of a non-matching male connector.

6 Claims, 16 Drawing Sheets

TERMINAL MODULE FOR ELECTRIC CONNECTOR

BACKGROUND OF THE INVENTION

1. Field of the Invention

The present invention relates to electrical connector technology and more particularly, to a terminal module for RJ45 female connector, which has the first and eighth transmission terminals specially designed to avoid deformation upon insertion of a non-matching male connector, assuring excellent transmission quality and application functions.

2. Description of the Related Art

A conventional RJ45 female connector (RJ45 jack), as shown in FIGS. 1~6, generally comprises a housing 8 and a terminal module 9 (see FIG. 4). The terminal module 9 comprises a circuit board 90 (see FIG. 3) and pairs of piercing terminals (not shown). This design of RJ45 female connector is adapted for the connection of an RJ45 male connector (RJ45 plug). An RJ45 male connector comprises 8 channels corresponding to the transmission terminals 91~98 of the terminal module 9 of an RJ45 female connector. However, because RJ-series male connectors have the same configuration, a user may falsely insert an RJ11 male connector 80 or any other non-matching RJ-series male connector into an RJ 45 female connector. As an RJ11 male connector 80 simply comprises 6 channels 800 (see FIG. 2), inserting an RJ11 male connector 80 into an RJ45 female connector will cause the two opposing lateral edges 801 of the bottom wall of the RJ11 male connector to squeeze the first transmission terminal 91 and eighth transmission terminal 98 of the terminal module 9. Referring also to FIGS. 5 and 6, because the fulcrums 901;908 of the $1^{st}$ and $8^{th}$ transmission terminals 91;98 are at the center area of the circuit board 90, the distance between the point of load 911;981 and the fulcrums 901;908 is short, and therefore the $1^{st}$ and $8^{th}$ transmission terminals 91;98 may be unable to return to their former shape (see the imaginary line in FIGS. 7 and 8), affecting transmission quality or causing damage or function failure.

SUMMARY OF THE INVENTION

The present invention has been accomplished under the circumstances in view. It is one object of the present invention to provide a terminal module for a female electric connector, which prevents terminal deformation upon insertion of a non-matching male connector, assuring excellent transmission quality and application functions.

To achieve this and other objects of the present invention, a terminal module comprises a circuit board, a plurality of piercing terminals installed in one side of the circuit board, and a plurality of transmission terminals numbered from $1^{st}$ through $8^{th}$ and installed in an opposite side of the circuit board. Each transmission terminal comprises a bonding portion at one end and a contact portion at an opposite end. The first transmission terminal comprises a triangle support connected between the bonding portion and contact portion thereof. Based on the principle of triangle support, the triangle support of the first transmission terminal transfers received pressure to the original fulcrum and the new fulcrum when the first transmission terminal is improperly squeezed, minimizing the load at the original fulcrum. Further, the distance between the inner end of the bonding portion of the first transmission terminal and the upper end of the upward bent of the triangle support is longer than the distance between the upper end of the upward bent of the triangle support and the front end of the contact portion so that the point of load can be extended forwardly to a place far from the original fulcrum, and therefore the first transmission terminal is not deformed when improperly squeezed.

Further, the eighth transmission terminal comprises a support connected between the bonding portion and contact portion thereof. Further, the distance between the inner end of the bonding portion of the eighth transmission terminal and the upper end of the support is longer than the distance between the upper end of the support and the front end of the contact portion so that the point of load can be extended forwardly to a place far from the original fulcrum. Thus, when the eighth transmission terminal is improperly squeezed, the point of load is far from the original fulcrum of the eighth transmission terminal, minimizing the pressure received by the original fulcrum and avoiding deformation of the eighth transmission terminal. Further, the contained angle defined between the inner end of the bonding portion and the support and the contained angle defined between the contact portion and the support are arc guide angles that enhance the elastic restoring force when the eighth transmission terminal is squeezed improperly.

DETAILED DESCRIPTION OF THE INVENTION

Figure 1:
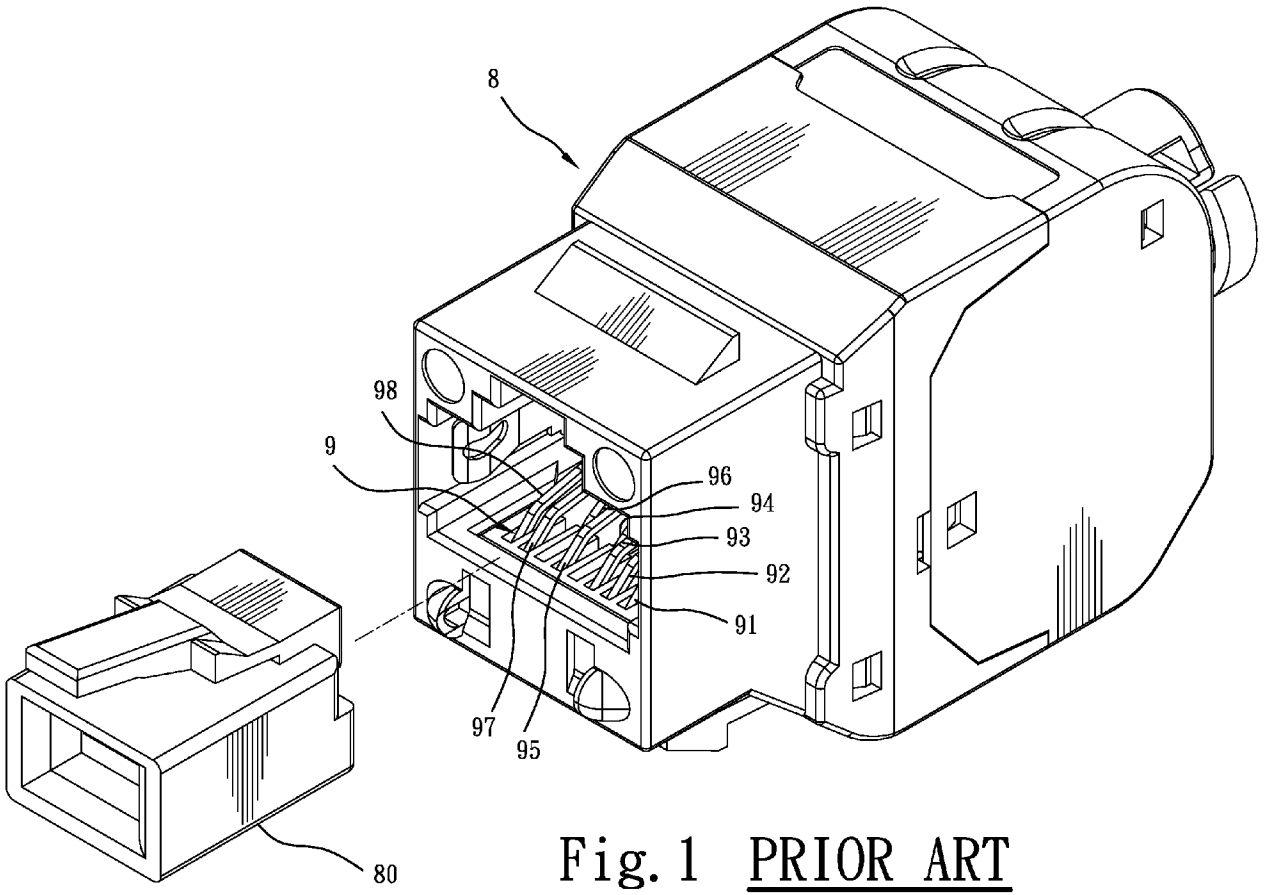
Fig. 1 PRIOR ART
FIG. 1 illustrates an RJ45 female connector and an RJ11 male connector according to the prior art.
Figure 2:
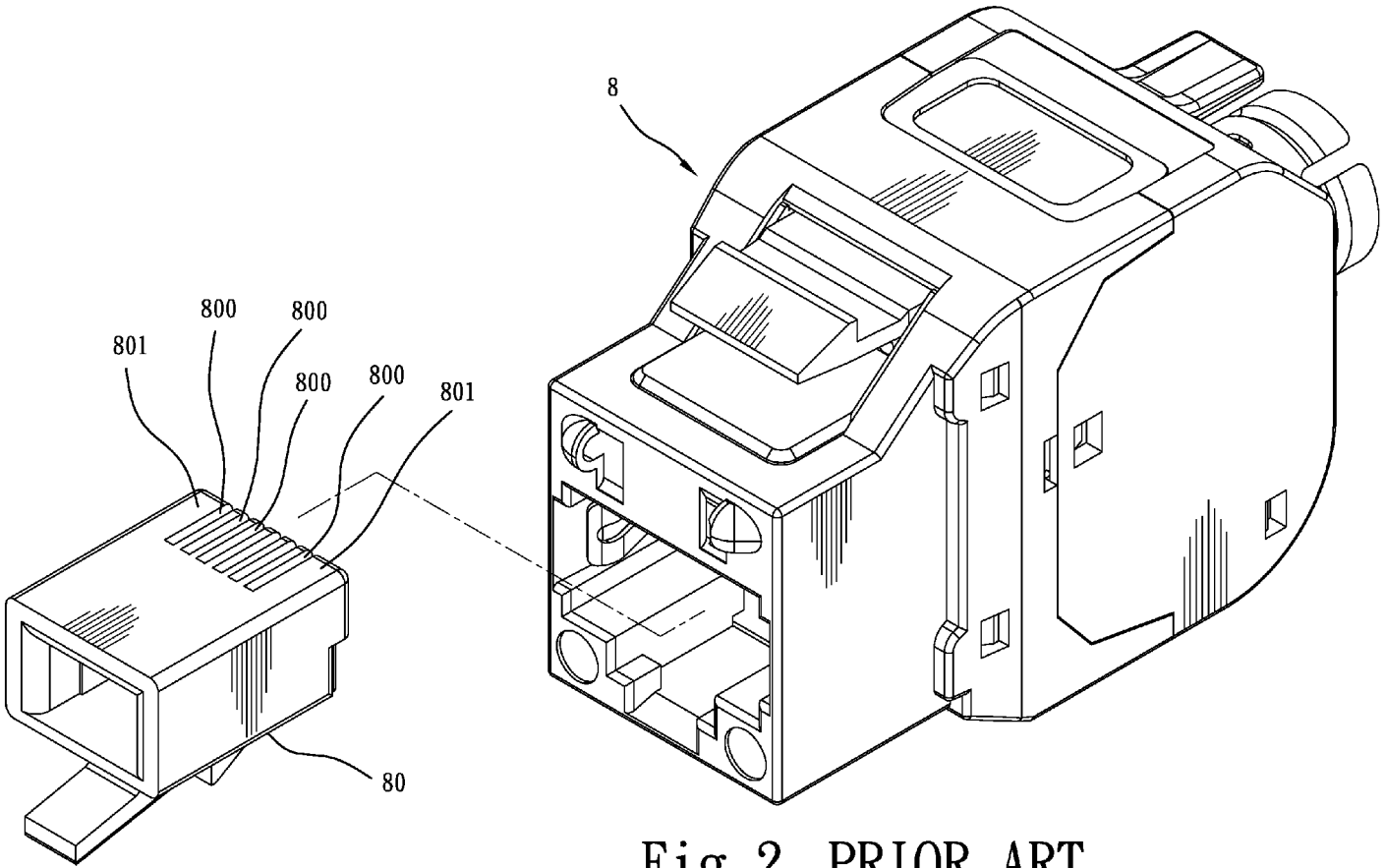
Fig. 2 PRIOR ART
FIG. 2 corresponds to FIG. 1 when viewed from the bottom side.
Figure 3:
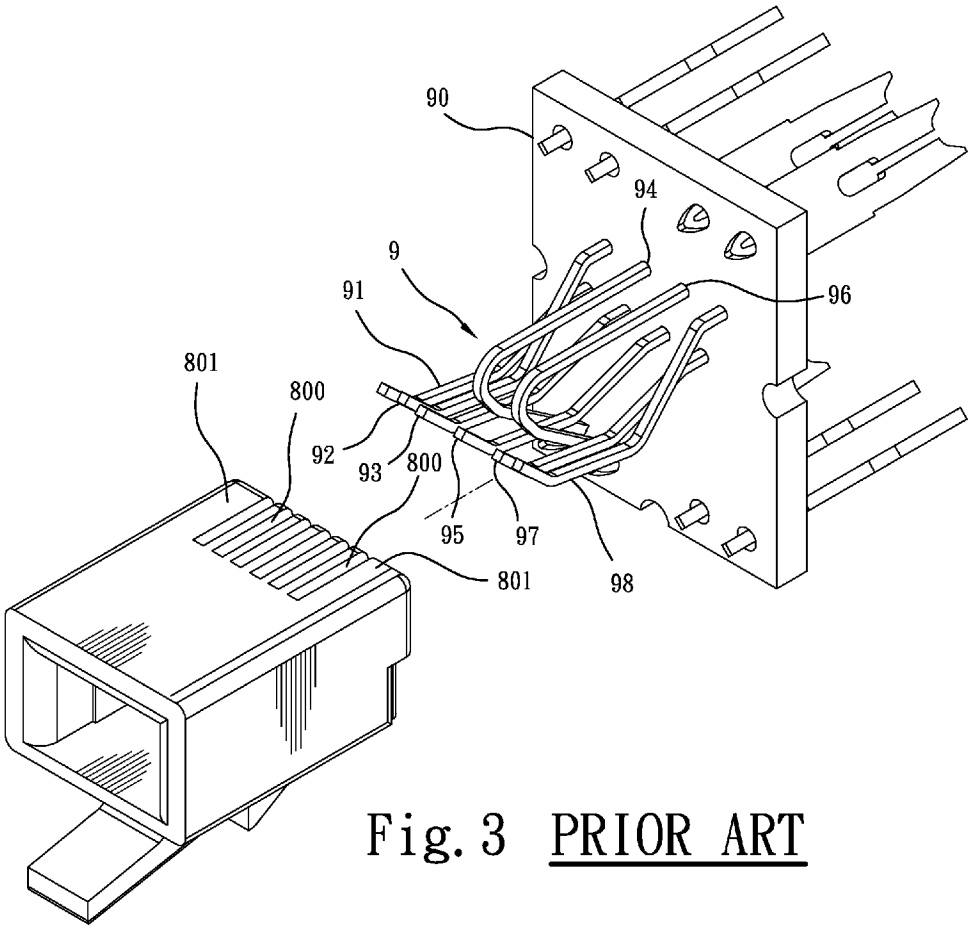
Fig. 3 PRIOR ART
FIG. 3 illustrates an RJ11 male connector and a terminal module for RJ45 female connector according to the prior art.
Figure 4:
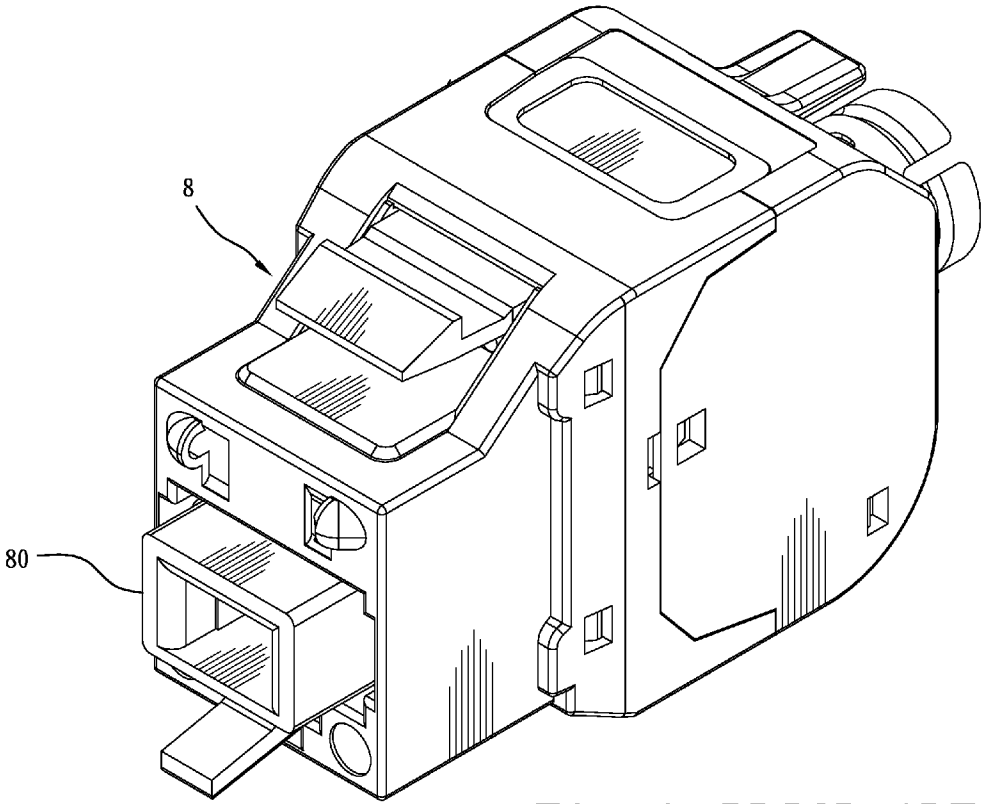
Fig. 4 PRIOR ART
FIG. 4 illustrates an RJ male connector erroneously inserted into an RJ45 female connector.

Referring to FIGS. 9~13, a terminal module 1 is shown for use in an electric connector, for example, RJ45 female connector, comprising a circuit board 2, a plurality of piercing terminals 3;3' installed in the circuit board 2 at one side and extending in a direction that defines with the insertion direction of an external RJ45 plug a contained angle of 180 degrees, and a plurality of transmission terminals 11~18 installed in the circuit board 2 at an opposite side.

The transmission terminals 11~18 are numbered $1^{st}$ through $8^{th}$, each comprising a bonding portion 111;121;131;141;151;161;171;181 at one end and a contact portion 112;122;132;142;152;162;172;182 at an opposite end.

The circuit board 2 comprises a plurality of, for example, 8 mounting holes 201;202 bilaterally and symmetrically arranged in two rows, and a plurality of, for example, 8 locating holes 21~28 arranged in two rows at different elevations between the two rows of mounting holes 201;202 in a staggered manner. The piercing terminals 3;3' are respectively bonded to the mounting holes 201;202 of the circuit board 2. The bonding portions 111;121;131;141;151;161;171;181 of the transmission terminals 11~18 are respectively bonded to the locating holes 21~28, wherein the $1^{st}$, $3^{rd}$, $5^{th}$ and $7^{th}$ transmission terminals 11;13;15;17 are respectively bonded to the upper row of locating holes 21;23;25;27; the $2^{nd}$, $4^{th}$, $6^{th}$ and $8^{th}$ transmission terminals 12;14;16;18 are respectively bonded to the lower row of locating holes 22;24;26;28.

The terminal module 1 is characterized in that:

The first transmission terminal 11 further comprises a triangle support portion 113 connected between the bonding portion 111 and the contact portion 112. The triangle support portion 113 comprises a downward bent 1131 downwardly extended from an inner end 1110 of the bonding portion 111, an upward bent 1132 having a lower end 1130 thereof connected to one end of the downward bent 1131 opposite to the bonding portion 111 and an upper end 1133 thereof connected to the rear end of the contact portion 112, which slopes downwardly forwards and terminating in a downward tip 1121. In actual practice, the design of the downward tip 1121 is not a limitation, i.e., the contact portion 112 can extend vertically downwardly from the upper end 1133 or in a curved manner.

The eighth transmission terminal 18 further comprises a support portion 183 connected between the bonding portion 181 and the contact portion 182. The support portion 183 extends obliquely upwardly from the inner end 1810 of the bonding portion 181 and terminating in an upper end 1831 that is connected to the contact portion 182. The contact portion 182 slopes downwardly forwards and terminating in a downward tip 1832. In actual practice, the design of the downward tip 1832 is not a limitation, i.e., the contact portion 182 can extend vertically downwardly from the upper 1831 of the support portion 183 or in a curved manner.

Figure 12:
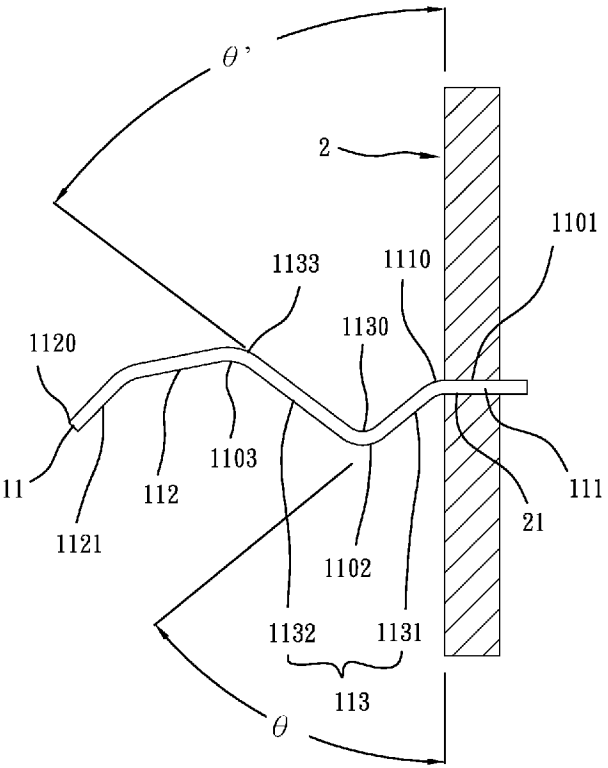
FIG. 12 is a schematic sectional view of the present invention, illustrating the configuration of the first transmission terminal and its relationship relative to the circuit board.
Figure 5:
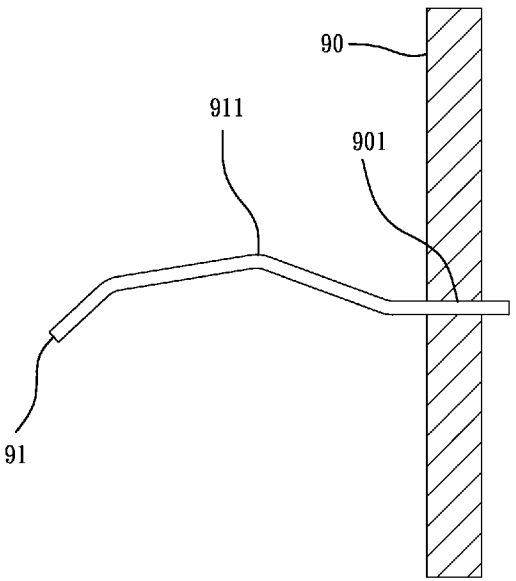
Fig. 5 PRIOR ART
FIG. 5 is a schematic sectional view of a part of the terminal module of the prior art RJ45 female connector, illustrating the arrangement of the first transmission terminal at the circuit board.
Figure 13:
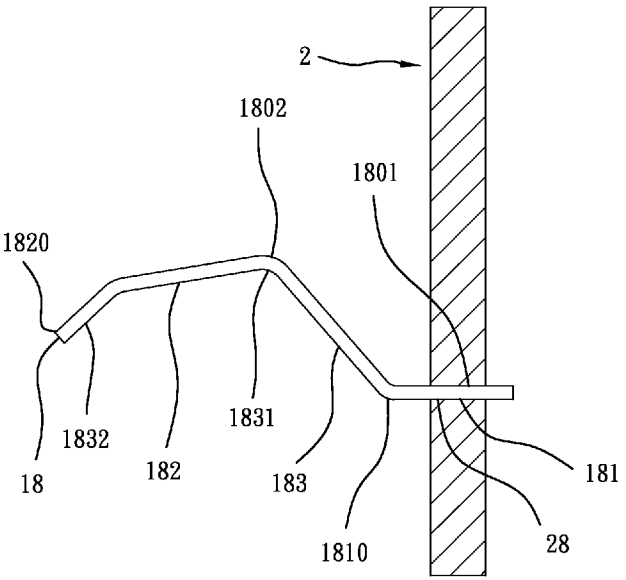
FIG. 13 is a schematic sectional view of the present invention, illustrating the configuration of the eighth transmission terminal and its relationship relative to the circuit board.
Figure 6:
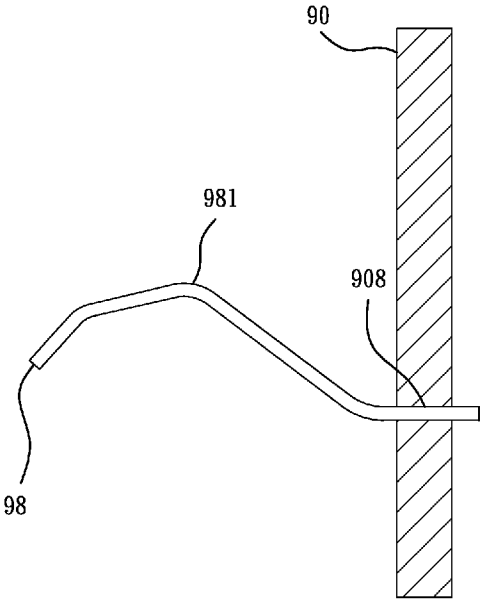
Fig. 6 PRIOR ART
FIG. 6 is a schematic sectional view of a part of the terminal module of the prior art RJ45 female connector, illustrating the arrangement of the eighth transmission terminal at the circuit board.

Referring to FIG. 12, the downward bent 1131 of the triangle support portion 113 of the first transmission terminal 11 preferably defines with the circuit board 2 a 40°~60° contained angle θ; the upward bent 1132 of the triangle support portion 113 of the first transmission terminal 11 preferably defines with the circuit board 2 a 48°~55° contained angle θ. On the basis of triangle support, the triangle support portion 113 transfers received pressure to the original fulcrum 1101 and the new fulcrum 1102 when improperly squeezed, avoiding deformation of the first transmission terminal 111.

Figure 16:
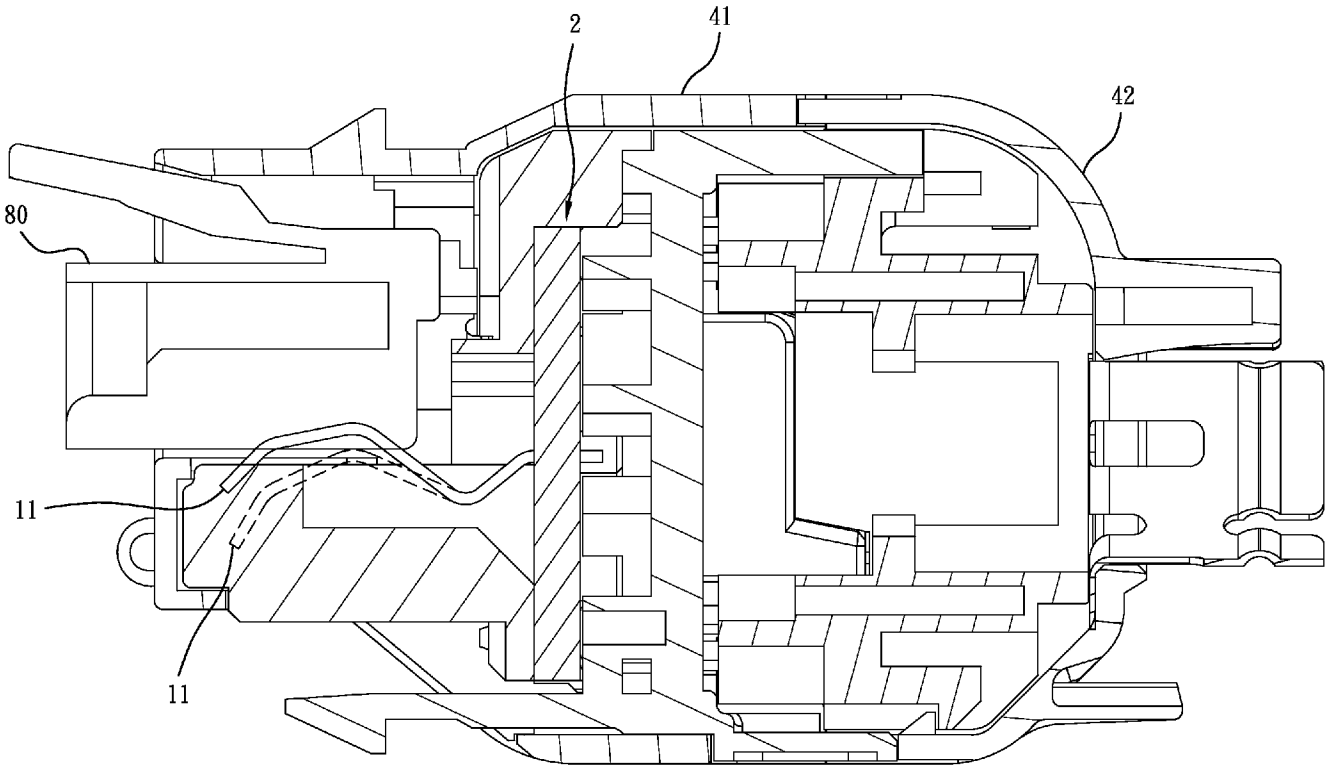
FIG. 16 is a schematic sectional side plain view illustrating a status of the first transmission terminal in the RJ45 female connector upon an erroneous insertion of an RJ11 male connector.

Further, the distance between the inner end 1110 of the bonding portion 111 of the first transmission terminal 11 and the upper end 1133 of the upward bent 1132 of the triangle support portion 113 is longer than the distance between the upper end 1133 of the upward bent 1132 of the triangle support portion 113 and the front end 1120 of the contact portion 112 so that the point of load can be extended forwardly to a place far from the original fulcrum 1101. Thus, when the first transmission terminal 11 is improperly squeezed, the point of load 1103 is far from the original fulcrum 1101 of the first transmission terminal 11, minimizing the pressure received by the original fulcrum 1101 and avoiding deformation of the first transmission terminal 11. FIG. 16 illustrates the first transmission terminal 11 squeezed by an RJ11 male connector 80 that is falsely inserted into the RJ45 female connector. Because of minor deformation (see the imaginary line) and subject to the aforesaid characteristic, the first transmission terminal 11 can return to its former shape almost completely.

Figure 17:
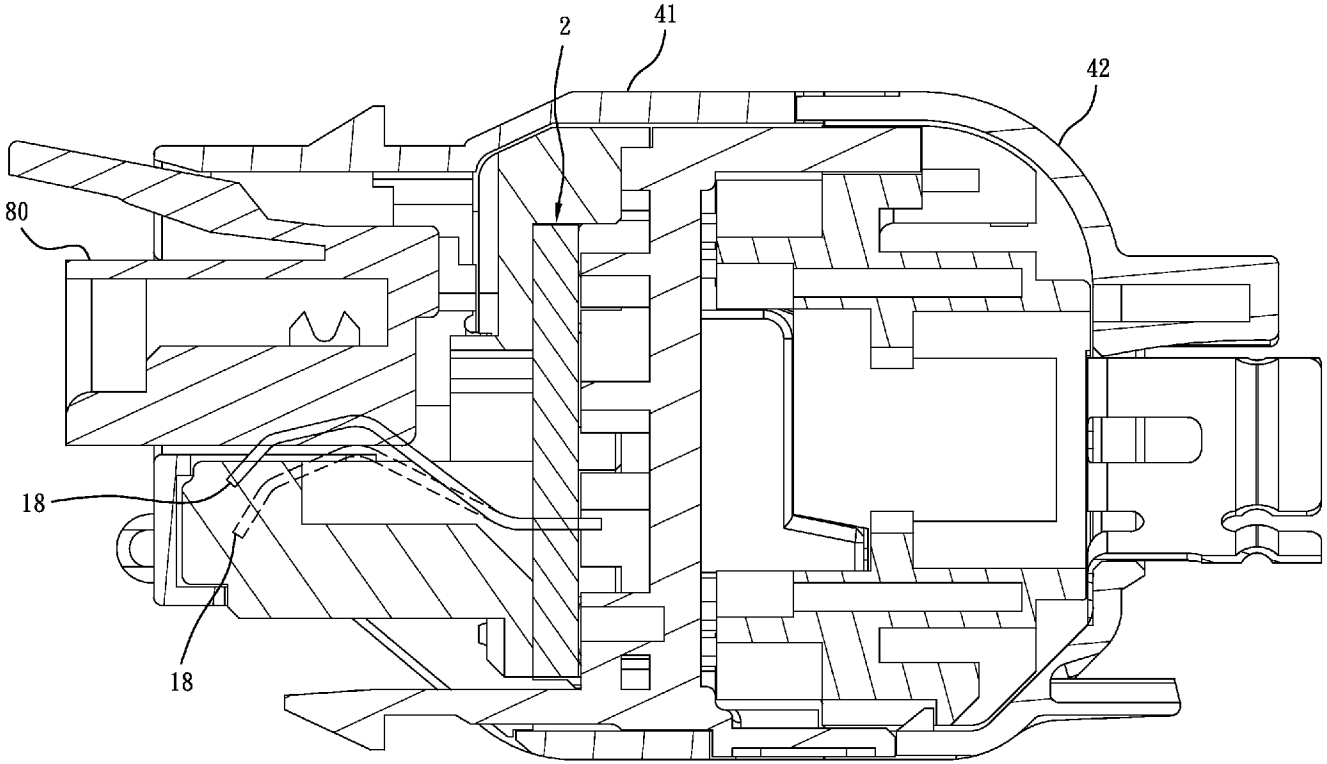
FIG. 17 is a schematic sectional side plain view illustrating a status of the eighth transmission terminal in the RJ45 female connector upon an erroneous insertion of an RJ11 male connector.

Further, the distance between the inner end 1810 of the bonding portion 181 of the eighth transmission terminal 18 and the upper end 1831 of the support portion 183 is longer than the distance between the upper end 1831 of the support portion 183 and the front end 1820 of the contact portion 182 so that the point of load can be extended forwardly to a place far from the original fulcrum 1801. Thus, when the eighth transmission terminal 18 is improperly squeezed, the point of load is far from the original fulcrum 1801 of the eighth transmission terminal 18, minimizing the pressure received by the original fulcrum 1801 and avoiding deformation of the eighth transmission terminal 18. FIG. 17 illustrates the eighth transmission terminal 18 squeezed by an RJ11 male connector 80 that is falsely inserted into the RJ45 female connector. Because of minor deformation (see the imaginary line) and subject to the aforesaid characteristic, the eighth transmission terminal 18 can return to its former shape almost completely. Further, the contained angle defined between the inner end 1810 of the bonding portion 181 and the support portion 183 is an arc guide angle; the contained angle defined between the contact portion 182 and the support portion 183 is also an arc guide angle. This design enhances the elastic restoring force when the eighth transmission terminal 18 is squeezed improperly.

Figure 14:
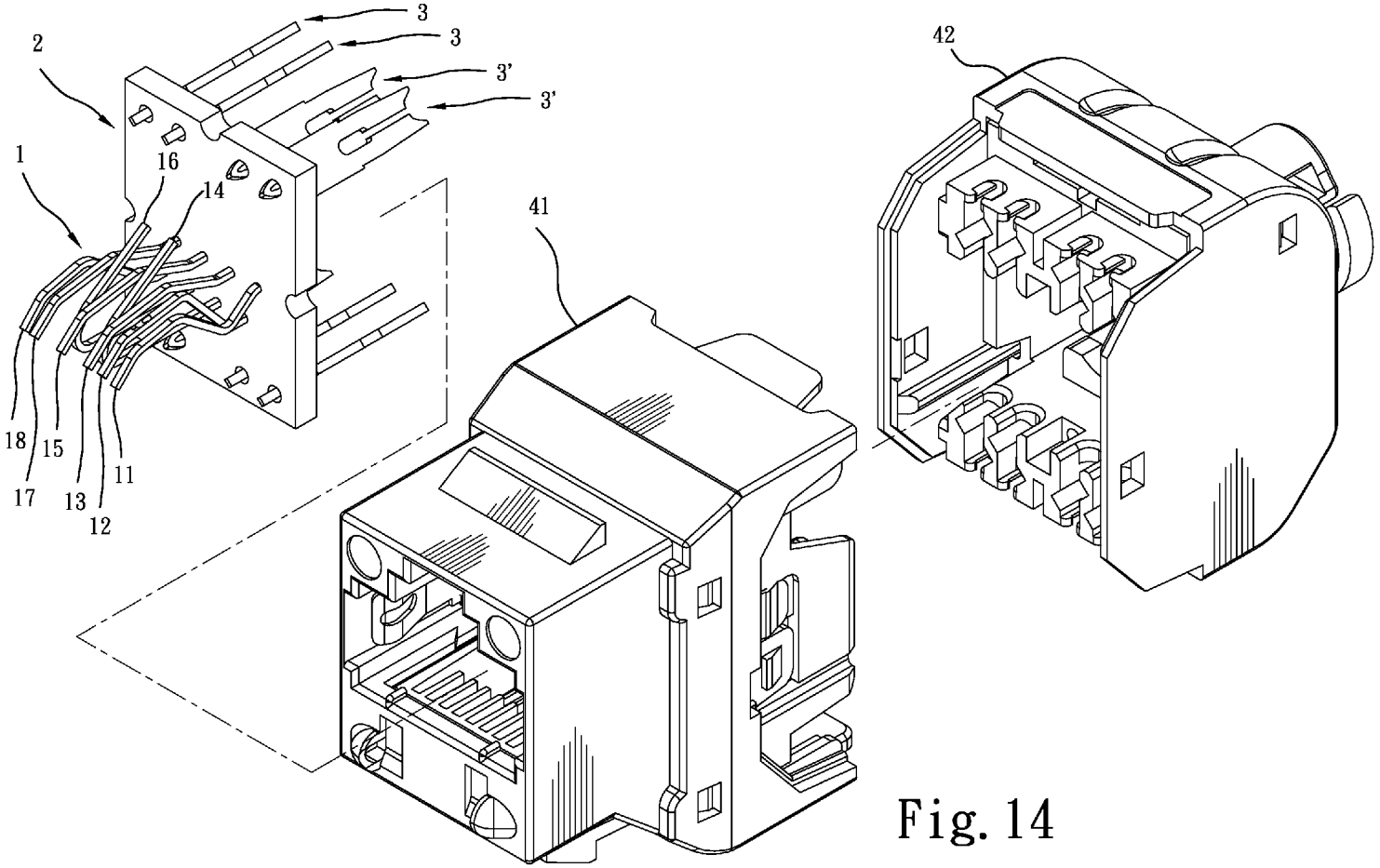
FIG. 14 is an exploded view of an RJ45 female connector constructed in accordance with the present invention.
Figure 15:
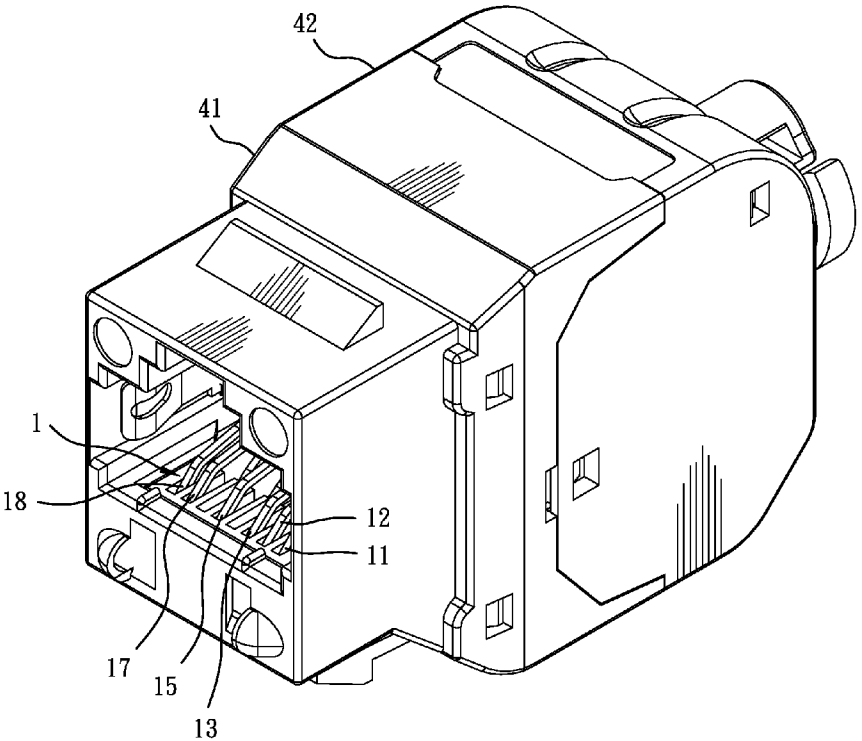
FIG. 15 is an elevational assembly view of FIG. 14.

Further, the design of the terminal module 1 can be used in different electric female connectors. FIG. 14 is an exploded view of an electric female connector constructed according to the present invention, which comprises a front housing 41, a rear housing 42 and a terminal module 1. FIG. 15 is an elevational assembly view of FIG. 14. FIGS. 16 and 17 illustrate the status of the first and eighth transmission terminals 11;18 upon false insertion of an RJ45 male connector 80. As the front housing 41 and the rear housing 42 are not within the scope of the claims of the present invention, no further detailed description in this regard is necessary.

Figure 18:
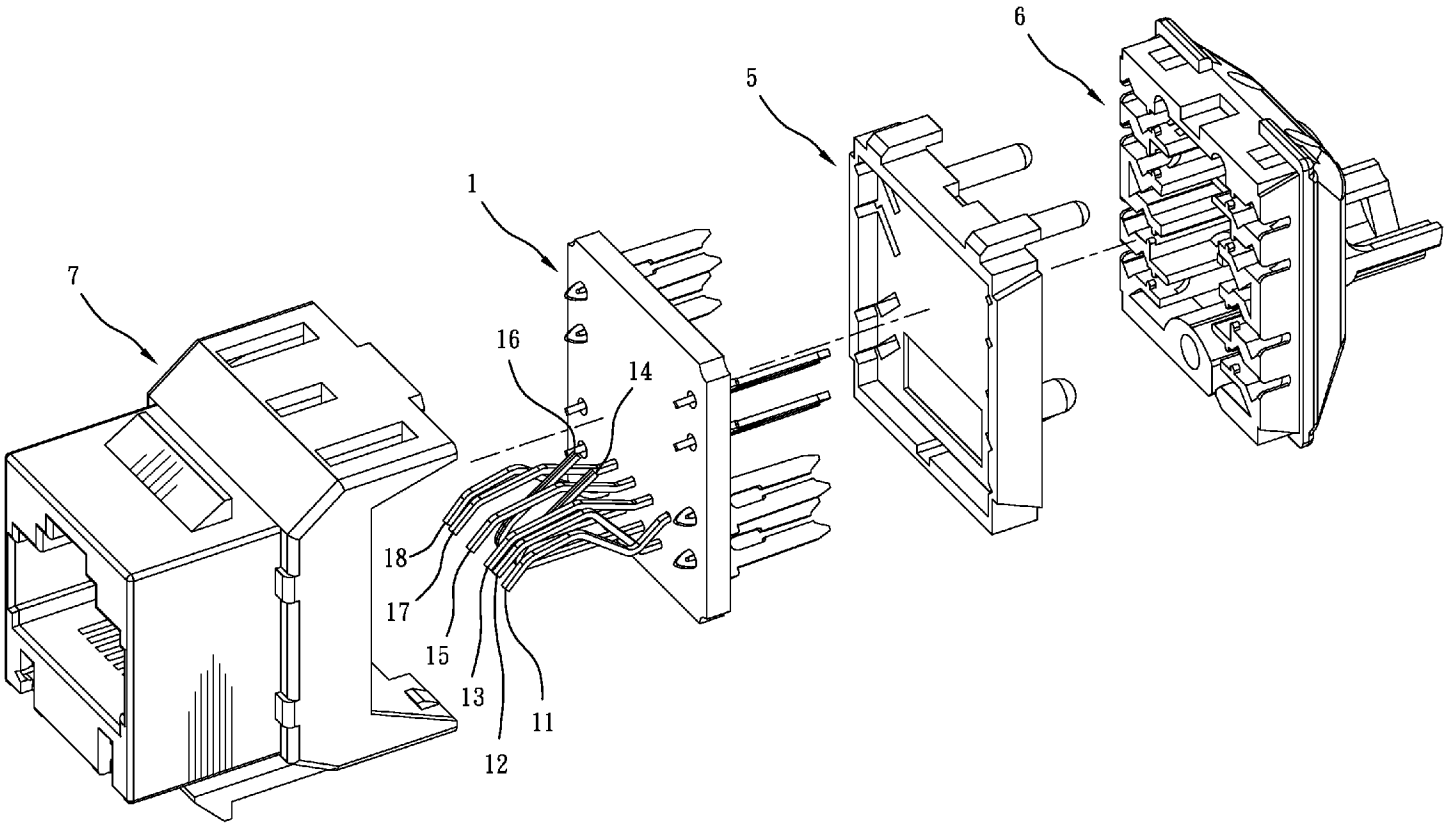
FIG. 18 is an exploded view of another design of electric female connector constructed according to the present invention.
Figure 19:
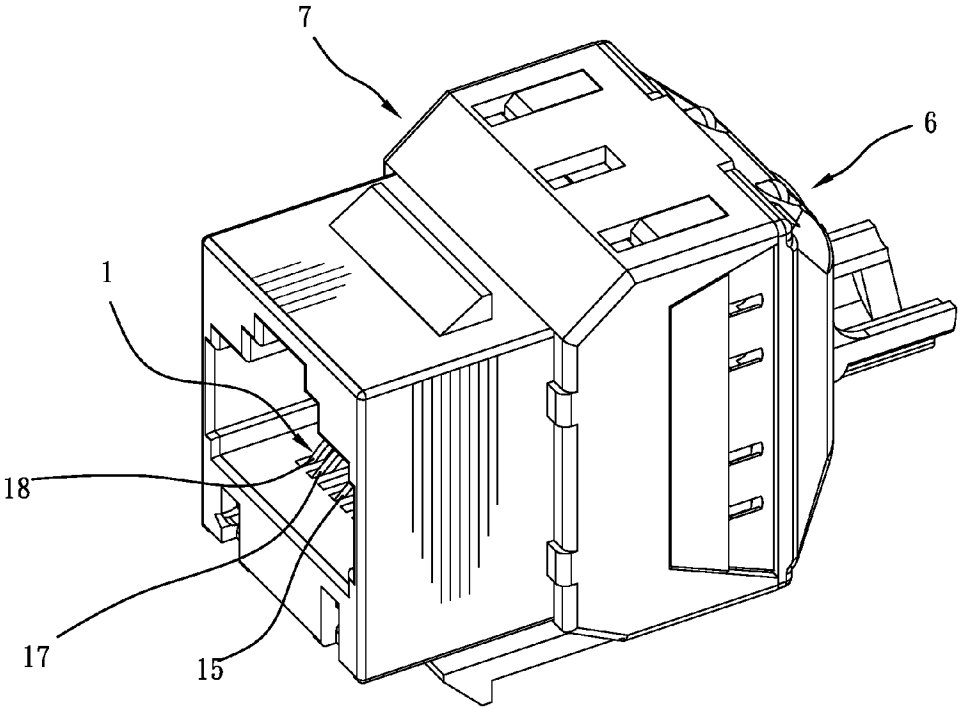
FIG. 19 is an elevational assembly view of the electric female connector shown in FIG. 18.

FIG. 18 is an exploded view of another design of electric connector constructed according to the present invention, which comprises a terminal module 1, a module holder 5, a cable organizer 6 and a housing 7. FIG. 19 is an elevational view of the electric connector shown in FIG. 18. The module holder 5, the cable organizer 6 and the housing 7 are of the known art and not within the scope of the present invention, no further detailed description in this regard is necessary.

Figure 7:
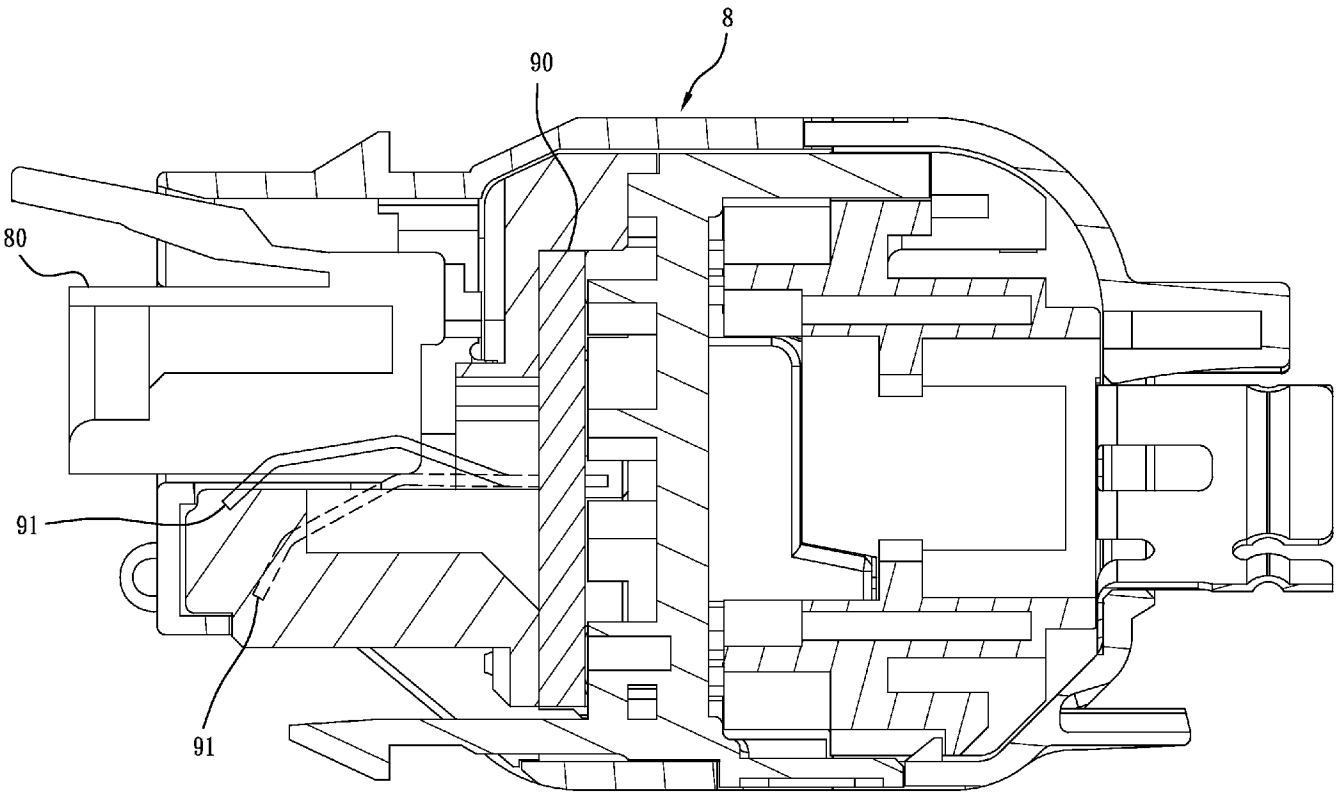
Fig. 7 PRIOR ART
FIG. 7 is a schematic sectional view of the prior art design, illustrating the first transmission terminal deformed upon an erroneous insertion of an RJ11 male connector into the RJ45 female connector.
Figure 8:
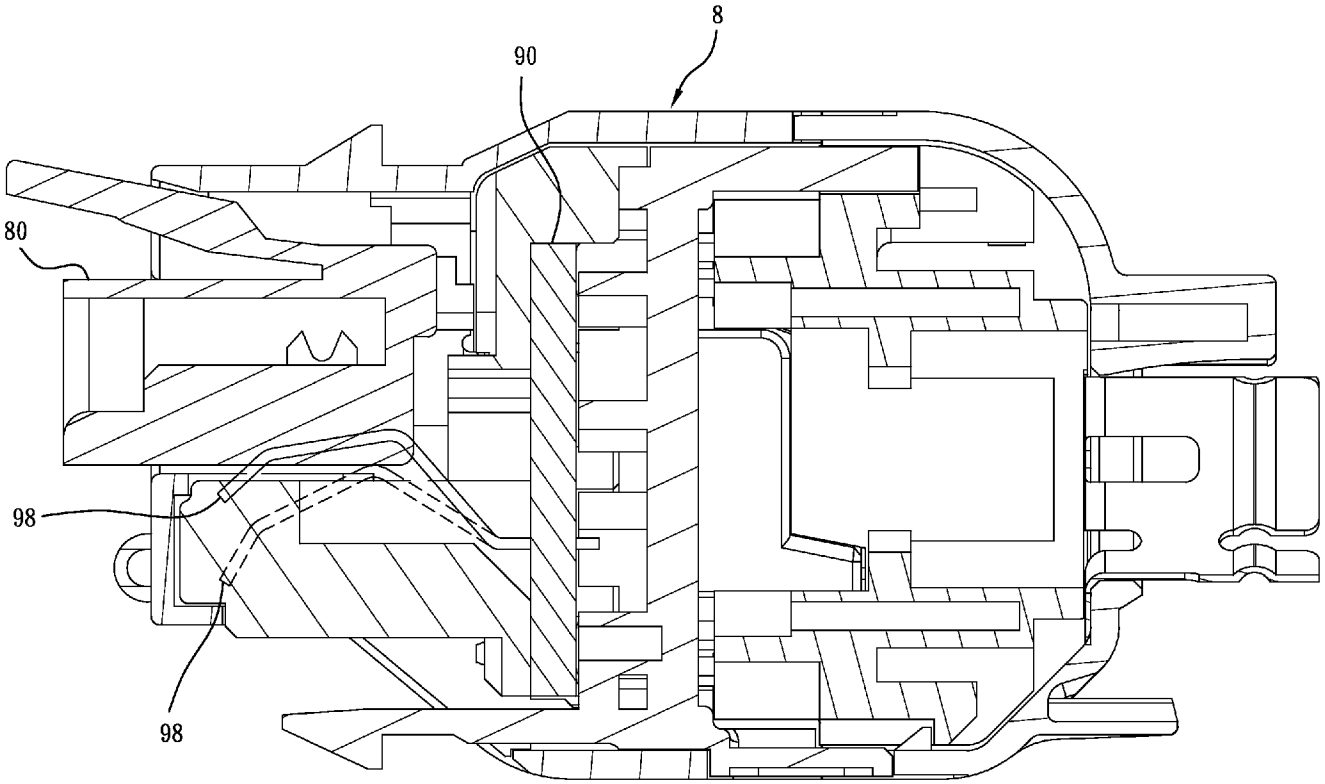
Fig. 8 PRIOR ART
FIG. 8 is a schematic sectional view of the prior art design, illustrating the eighth transmission terminal deformed upon an erroneous insertion of an RJ11 male connector into the RJ45 female connector.
Figure 9:
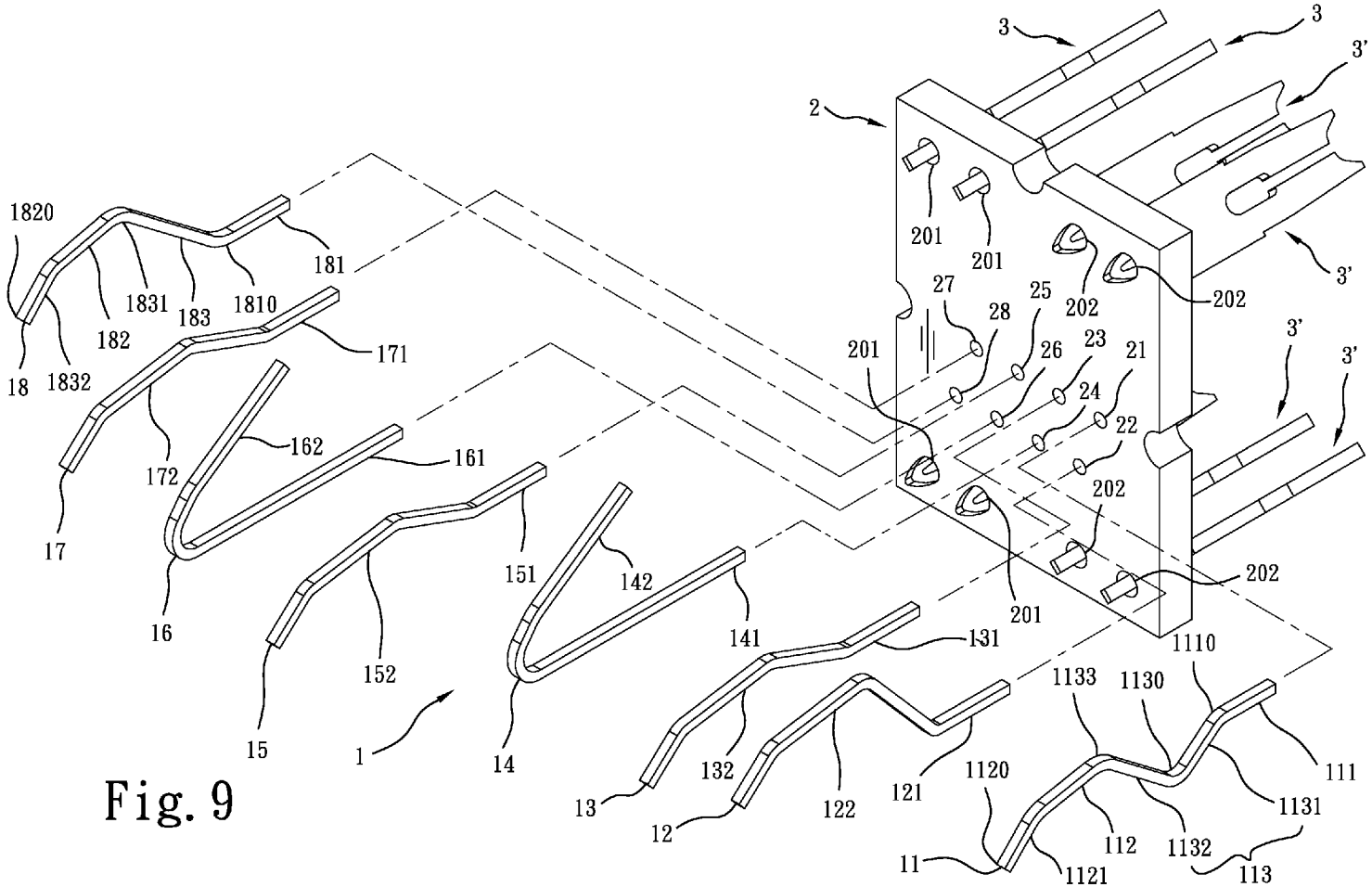
FIG. 9 is an exploded view of a terminal module for electric connector in accordance with the present invention.
Figure 11:
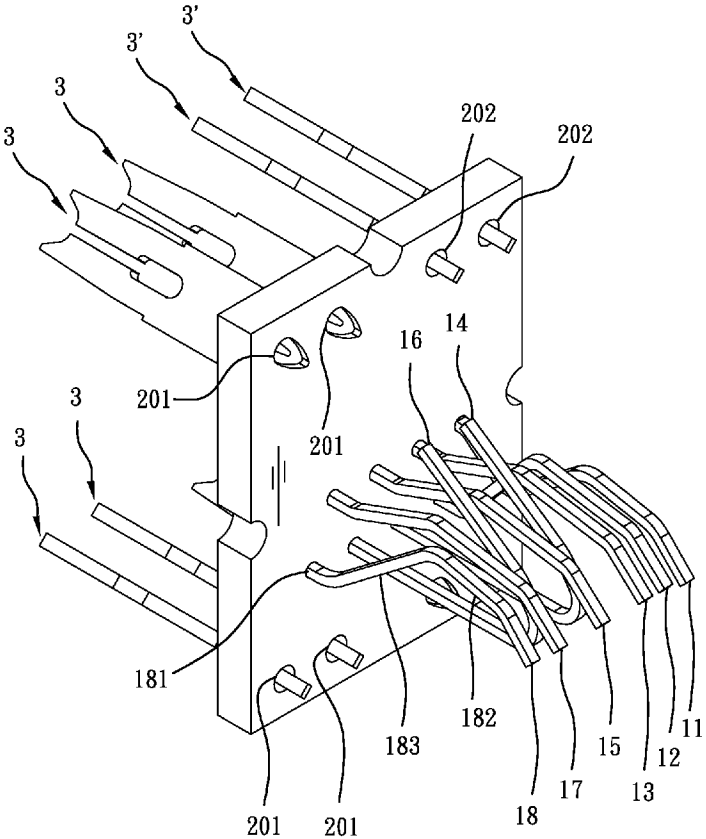
FIG. 11 corresponds to FIG. 10 when viewed from another angle.
Figure 10:
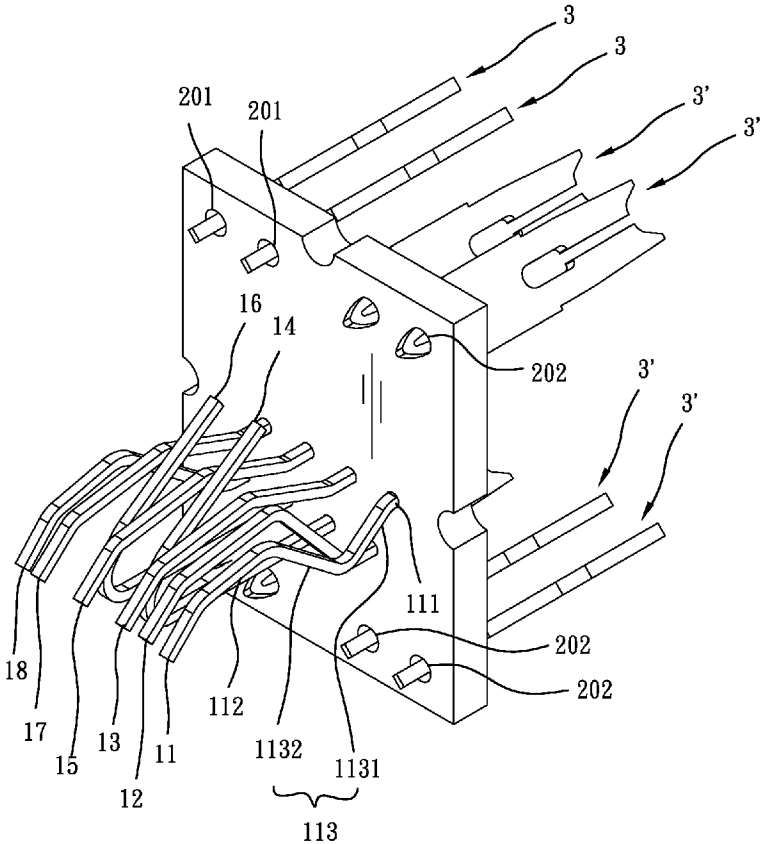
FIG. 10 is an elevational assembly view of the terminal module in accordance with the present invention.

In conclusion, the invention provides a terminal module for electric connector, which has the following advantages and features:

1. Based on the principle of triangle support, the triangle support portion 113 of the first transmission terminal 11 transfers received pressure to the original fulcrum 1101 and the new fulcrum 1102 (see FIG. 12) when the first transmission terminal 11 is improperly squeezed, minimizing the load at the original fulcrum 1101; further, the distance between the inner end 1110 of the bonding portion 111 of the first transmission terminal 11 and the upper end 1133 of the upward bent 1132 of the triangle support portion 113 is longer than the distance between the upper end 1133 of the upward bent 1132 of the triangle support portion 113 and the front end 1120 of the contact portion 112 so that the point of load can be extended forwardly to a place far from the original fulcrum 1101, and therefore the first transmission terminal 11 is not deformed when improperly squeezed. When compared to the prior art design shown in FIG. 7 in which the first transmission terminal 91 will be deformed and unable to return to its former shape when erroneously squeezed by an RJ11 male connector 80, the first transmission terminal 11 of the present invention, as shown in FIG. 16, will not be significantly deformed when squeezed erroneously by an RJ11 male connector 80 and can completely return to its former shape, assuring excellent transmission quality and application functions.
2. The distance between the inner end 1810 of the bonding portion 181 of the eighth transmission terminal 18 and the upper end 1831 of the support portion 183 is longer than the distance between the upper end 1831 of the support portion 183 and the front end 1820 of the contact portion 182 so that the point of load can be extended forwardly to a place far from the original fulcrum 1801. Thus, when the eighth transmission terminal 18 is improperly squeezed, the point of load 1803 is far from the original fulcrum 1801 of the eighth transmission terminal 18, minimizing the pressure received by the original fulcrum 1801 and avoiding deformation of the eighth transmission terminal 18. When compared to the prior art design shown in FIG. 8 in which the eighth transmission terminal 98 will be heavily deformed and unable to return to its former shape when erroneously squeezed by an RJ11 male connector 80, the eight transmission terminal 18 of the present invention, as shown in FIG. 17, will not be significantly deformed when squeezed erroneously by an RJ11 male connector 80 and can completely return to its former shape, maintaining transmission quality and application function; further, the contained angle defined between the inner end 1810 of the bonding portion 181 and the support portion 183 and the contained angle R defined between the contact portion 182 and the support portion 183 are arc guide angles that enhance the elastic restoring force when the eighth transmission terminal 18 is squeezed improperly.

What is claimed is:

1. A terminal module used in an electric female connector, comprising a circuit board, a set of piercing terminals installed in one side of said circuit board and extending at an angle about 180 degrees relative to the insertion direction of a matching electric male connector connectable to said electric female connector, and a set of transmission terminals numbered $1^{st}$ through $8^{th}$ and installed in an opposite side of said circuit board, each said transmission terminal comprising a bonding portion disposed at one end thereof and a contact portion disposed at an opposite end thereof, said circuit board comprising a plurality of mounting holes bilaterally and symmetrically arranged in two rows, and a plurality of locating holes arranged in two rows at different elevations between the two rows of mounting holes in a staggered manner, said piercing terminals being respectively bonded to the mounting holes of said circuit board, the bonding portions of the $1^{st}$, $3^{rd}$, $5^{th}$ and $7^{th}$ transmission terminals being respectively bonded to the upper row of locating holes of said circuit board, the $2^{nd}$, $4^{th}$, $6^{th}$ and $8^{th}$ transmission terminals being respectively bonded to the lower row of locating holes of said circuit board, wherein:

said first transmission terminal further comprises a triangle support portion connected between the bonding portion and contact portion thereof, said triangle support portion comprising a downward bent downwardly extended from an inner end of the bonding portion, an upward bent having a lower end thereof connected to one end of said downward bent opposite to the bonding portion and an upper end thereof connected to the contact portion;

said eighth transmission terminal further comprises a support portion connected between the bonding portion contact portion thereof, said support portion extending obliquely upwardly from an inner end of the bonding portion and terminating in an upper end that is connected to the contact portion.

2. The terminal module as claimed in claim 1, wherein the downward bent of said triangle support portion of said first transmission terminal defines with said circuit board a contained angle within about 40°~60°.

3. The terminal module as claimed in claim 1, wherein the upward bent of said triangle support portion of said first transmission terminal defines with said circuit board a contained angle within about 48°~55°.

4. The terminal module as claimed in claim 1, wherein the distance between the inner end of the bonding portion of said first transmission terminal and the upper end of the upward bent of said triangle support portion is longer than the distance between the upper end of the upward bent of said triangle support portion and the distal end of the contact portion of said first transmission terminal.

5. The terminal module as claimed in claim 1, wherein the distance between the inner end of the bonding portion of said eighth transmission terminal and the upper end of said support portion is longer than the distance between the upper end of said support portion and the distal end of the contact portion of said eighth transmission terminal.

6. The terminal module as claimed in claim 1, wherein the contained angle defined between the inner end of the bonding portion of said eighth transmission terminal and said support portion and the contained angle defined between the contact portion of said eighth transmission terminal and said support portion are arc guide angles.

* * * * *